US005680837A

United States Patent [19]

Pierik

[11] Patent Number: 5,680,837

[45] Date of Patent: Oct. 28, 1997

[54] PLANETARY CAM PHASER WITH WORM ELECTRIC ACTUATOR

[75] Inventor: Ronald Jay Pierik, Rochester, N.Y.

[73] Assignee: General Motors Corporation, Detroit, Mich.

[21] Appl. No.: 715,148

[22] Filed: Sep. 17, 1996

[51] Int. Cl.[6] ..... F01L 1/344

[52] U.S. Cl. ..... 123/90.17; 123/90.31; 74/568 R; 464/2

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 1,220,124 | 3/1917 | Hoffner | 123/146.5 R |
| 4,476,823 | 10/1984 | Williams | 123/90.12 |
| 4,583,501 | 4/1986 | Williams | 123/90.15 |
| 4,976,229 | 12/1990 | Charles | 123/90.31 |
| 5,156,119 | 10/1992 | Suga | 123/90.31 |
| 5,174,253 | 12/1992 | Yamazaki et al. | 123/90.31 |
| 5,203,291 | 4/1993 | Suga et al. | 123/90.31 |
| 5,327,859 | 7/1994 | Pierik et al. | 123/90.17 |
| 5,355,849 | 10/1994 | Schiattino | 123/90.17 |
| 5,361,736 | 11/1994 | Phoenix et al. | 123/90.17 |
| 5,365,898 | 11/1994 | Mueller | 123/90.17 |
| 5,542,383 | 8/1996 | Clarke et al. | 123/90.17 |

*Primary Examiner*—Weilun Lo

[57] ABSTRACT

A planetary cam phaser includes an electric motor driven worm gear actuator for rotatably positioning a sun gear to vary the cam phase relative to the crankshaft of an associated engine. Preferably, the worm lead angle is made small to lock the actuator against back driving by camshaft generated forces so the phaser is actuated only by controlled motor movements. Alternatively, a return spring may be applied on the motor or worm shaft to return the phase to an initial position when the motor is de-energized or fails. In another version, the worm lead angle may be increased to permit limited back driving forces to drive the cam back to the initial position when the motor is off without the need for a return spring.

11 Claims, 3 Drawing Sheets

PLANETARY CAM PHASER WITH WORM ELECTRIC ACTUATOR

TECHNICAL FIELD

This invention relates to cam phasers for engine timing drives and more particularly to a worm gear electric actuator controlling a planetary cam phaser.

BACKGROUND OF THE INVENTION

U.S. Pat. No. 5,327,859, granted Jul. 12, 1994, to the assignee of the present invention, discloses an engine timing drive incorporating a planetary cam phaser for varying the phase angle between a driven camshaft and a driving crankshaft of an associated engine. A fixed phase drivetrain for an associated balance shaft is also included. The camshaft phase angle is varied by adjusting the angular position of a sun gear of the planetary gear train by means of a directly connected control shaft extending through a front cover of the associated engine. Any suitable means, not shown, may be used for adjusting the position of the control shaft to vary the camshaft phase or timing.

SUMMARY OF THE INVENTION

The present invention provides a planetary cam phaser combined with a preferred actuator in the form of an electric motor driven worm gear connected to adjust the angular position of the sun gear of the planetary gear train to vary the camshaft phase relative to the crankshaft of an associated engine. The worm electric actuator of the invention is considered superior to other forms of mechanical, hydraulic, electric, and manual actuators for this application. It provides a relatively large gear reduction so that a small electric drive motor can be utilized for driving the control shaft with sufficient torque to overcome friction and provide a fast phase change response.

Preferably, the lead angle of the worm is made sufficiently small to prevent back driving of the motor from the engine camshaft by locking up the worm gear train against movement by forces applied from the camshaft. In this case, controlled forward and reverse rotation of the motor alone controls the camshaft phase angle and the motor may be de-energized between movements. Alternatively, a return spring or other device may be provided to return the worm to a desired position upon shut off or failure of the drive motor. If desired, the worm lead angle may be made great enough to allow back driving forces from the camshaft to return the cam phase angle to a desired initial position upon motor shut off without the need for a return spring.

A compact and convenient mounting for the actuator assembly is provided by securing the actuator with its attached motor to an outer cover or front cover of the engine which encloses the planetary gear train and possibly other portions of the engine camshaft drive.

These and other features and advantages of the invention will be more fully understood from the following description of certain specific embodiments of the invention taken together with the accompanying drawings.

DESCRIPTION OF THE PREFERRED EMBODIMENT

Figure 1:
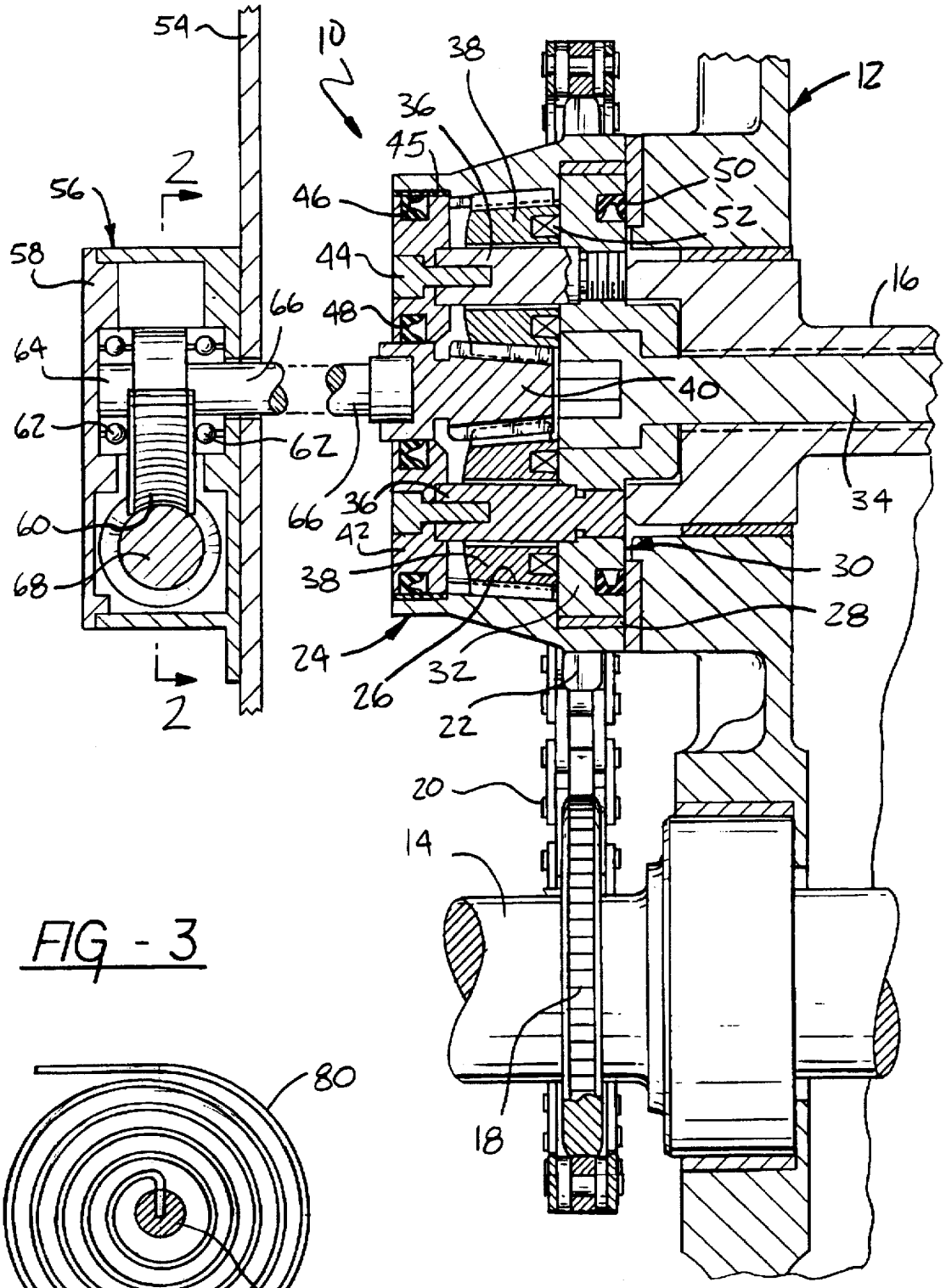
FIG. 1 is a longitudinal cross-sectional view of an engine camshaft drive taken through the plane of the camshaft and crankshaft axes and illustrating a cam phaser with worm electric actuator in accordance with the invention.

Referring now to the drawings in detail, FIG. 1 illustrates a four stroke cycle internal combustion engine which could be used, for example, in an automobile. Engine 10 includes a cylinder block 12 rotatably supporting a crankshaft 14 and a camshaft 16 mounted on parallel axes upwardly aligned along the central vertical plane of the engine.

At the front end of the engine, the crankshaft 14 carries a drive sprocket 18 that is connected by a chain 20 to a driven sprocket 22. Optionally, gear or timing belt drive means could be used in place of the chain drive shown. The driven sprocket 22 forms part of a planetary cam phaser or phase changer 24 that is mounted on the camshaft 16 as will subsequently be more fully described.

A ring gear 26 is fixed inside of or forms a part of the driven sprocket 22 for rotation therewith. The ring gear 26 and the driven sprocket 22 are rotatably supported by bearing 28 on a planet carrier 30. The carrier includes a drive flange 32 that is fixed by a screw 34 to the camshaft 16. The carrier 30 carries a plurality of, in this case four, stub shafts 36. Each stub shaft supports a planet gear 38 for rotation thereon. The planet gears 38 engage the ring gear 26 and a central sun gear 40. An annular cover 42 closes an open end of the planet carrier 30 and is secured by support screws 44 to the outer ends of the stub shafts 36 which are received in recesses of the cover 42. Bearing 45 supports the front end of the sprocket 22 on the cover 42. Seals 46, 48 and 50 may be provided to prevent the loss of engine oil lubricant from the planetary cam phaser assembly. Optionally biasing springs 52 may be provided for urging the conically shaped planetary gears axially against the mating conical ring and sun gears to take up lash in the assembly. This feature of the disclosure is claimed in a copending patent application.

Figure 2:
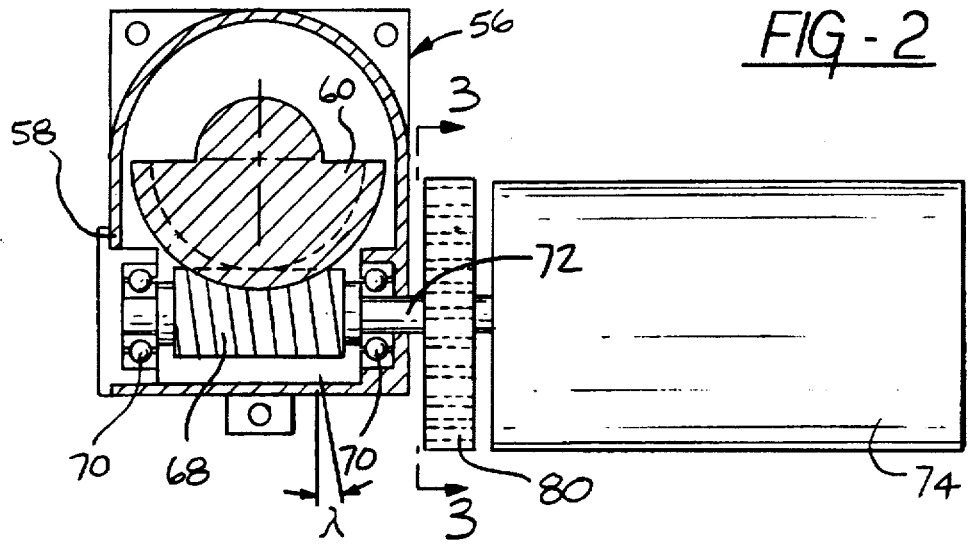
FIG. 2 is a transverse cross-sectional view from the plane of the line 2—2 of FIG. 1.

An outer timing chain or belt cover or front cover 54 is provided to enclose the portions of the planetary cam phaser so far described and prevent the loss or leakage of lubricant from the engine oil system. In accordance with the invention, a worm electric actuator generally indicated by numeral 56 is mounted upon the front cover 54. Actuator 56 includes a housing 58 which encloses a worm gear 60 that is mounted on bearings 62 for rotation on a longitudinal axis 64 that is coaxial with the axis of the associated engine camshaft. Worm gear 60 connects with an actuator shaft 66 which engages the sun gear 40 to provide a driving connection between the sun gear and the actuator worm gear 60. As is best shown in FIG. 2, the worm gear in the present instance is in the form of a half circular gear segment, since the required rotation thereof is not more than about 180°.

The worm gear 60 is rotatably driven by a worm 68 which is supported on bearings 70 within the housing 58 and is driven through a shaft 72 by a small electric motor 74.

In operation of the mechanism as so far described, the crankshaft 14 of engine 10 rotates during operation, driving the camshaft 16 through the planetary cam phaser 24. The ratios of the sprockets and the gears of the planetary gear train are chosen so that, when the sun gear 40 is held stationary, the camshaft is driven at one half crankshaft speed in a fixed phase relation thereto, as is conventional for a four stroke cycle engine. If a two stroke cycle engine were involved, the camshaft would normally be driven at the same speed as the crankshaft.

In order to change the phase relation of the camshaft with respect to the crankshaft while the engine is operating, for example to improve engine power or efficiency, the electric motor 74 is rotated in a desired direction by energizing the motor from an external control operated by the engine computer control system, not shown. Rotation of the motor 74 rotates the worm 68, causing the worm gear 60 to oscillate about its axis and thereby reposition or change the rotational position of the sun gear 40 in the planetary gear train. This change causes relative rotation of the planet carrier 30 within the driven sprocket 22, thereby rotating the camshaft 16 and changing its phase with respect to the driven sprocket 22 and the directly connected crankshaft 14. The motor 74 may be driven in forward or reverse directions to either advance or retard the camshaft phase angle and control the actuation of associated engine valves with respect to the timing of the crankshaft as desired.

In operation of an engine, the camshaft 16 will be subject to significant variations of, and possible reversals of, torque caused by the actuation by the cams of associated engine valves and/or other equipment. As a valve is opened, the valve spring produces a force against the cam tending to drive the camshaft in a reverse direction and, as the valve is closed, the valve spring produces a force against the cam which now tends to drive the camshaft in the forward direction of its rotation.

When several valves are being driven by the same camshaft, as is common, multiple reversals of torque load on the camshaft may occur during each rotation thereof. These torque reversals are significant and may momentarily be greater than the retarding or driving forces of the cam phaser according to the invention connected with the worm gear driven by the electric motor 74. To prevent the possibility of back driving the worm gear and electric motor system from the camshaft torques, the lead angle $\lambda$ of the worm 68 may be and preferably is selected taking into account the forces of friction in the worm gear drive, so that excessive back driving forces from the camshaft will cause the gears to lock and prevent rotation of the worm by the worm gear due to forces applied on the worm gear from the camshaft.

The ability of the worm gear drive to actuate the cam phaser using a relatively small electric motor operable at relatively high speed is due in part to the unique features of the worm drive and the selection of a proper worm lead angle in accordance with the friction coefficient between the worm and the worm gear. This friction coefficient varies with the operating conditions of the worm system between stationary and moving conditions.

Figure 4:
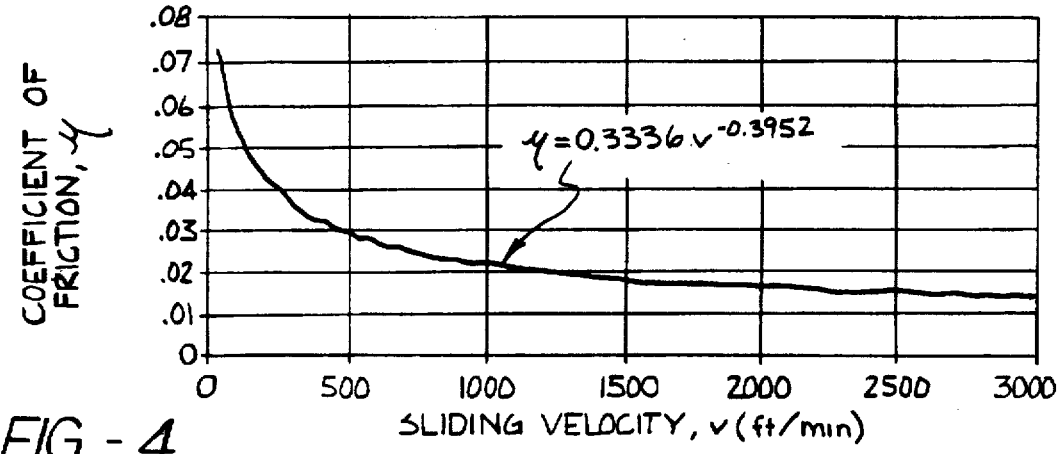
FIG. 4 is a graph illustrating the variation of the coefficient of friction versus sliding velocity of the worm to worm gear interface.

FIG. 4 illustrates graphically the change in the coefficient of friction $\mu$ with sliding velocity v of the worm to worm gear interface for a particular embodiment of worm electric actuator according to the invention. When the system is stationary, the coefficient of friction approaches or exceeds 0.08. However, as the rotational speed of the worm increases during operation, the improved lubrication between the teeth of the worm and the worm gear reduces the coefficient of friction quickly to about 0.03 at 500 ft/min. sliding velocity and down to below 0.02 at a sliding velocity of 1,500 ft/min. and above. Thus, when the worm drive system is stationary, the friction coefficient of the system is relatively high but, when the motor is actuated to drive the worm to vary the phase of the associated camshaft, the coefficient of friction is quickly reduced by the lubrication of the moving gear teeth so that the relatively small motor is able to quickly move the worm gear from the initial position to the new phase angle position selected by the engine control.

Figure 5:
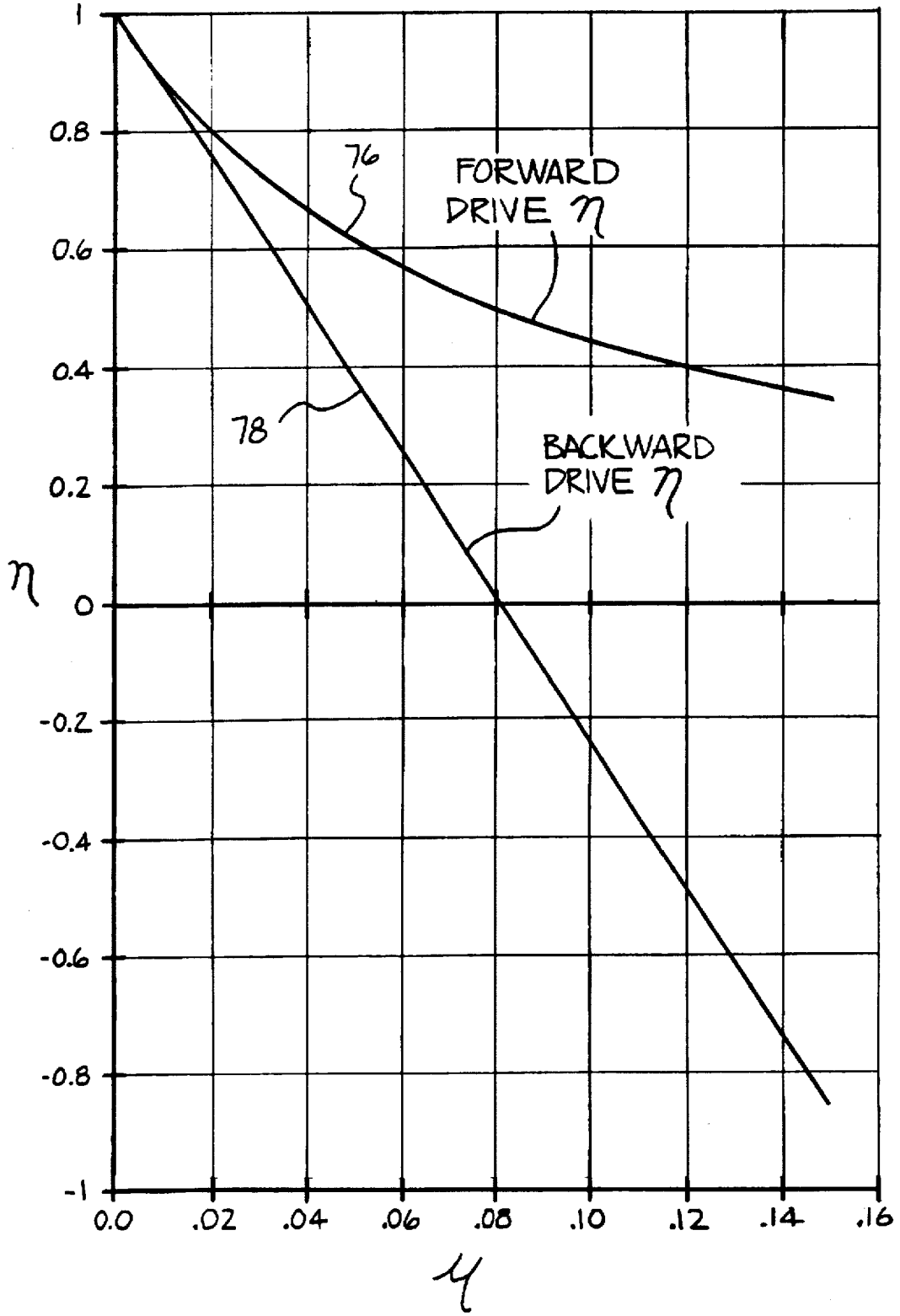
FIG. 5 is a graph illustrating the variation in drive efficiency versus friction coefficient for a specific combination of gear pressure angle and worm lead angle.

FIG. 5 graphically illustrates another important advantage of the worm drive system in this application. This graph is based upon data for a particular embodiment in which the gears of the worm and the worm gear are formed with a 14.5° pressure angle and the worm has a lead angle $\lambda$ of 4.75°. With these conditions, the drive efficiency $\eta$ of the gear system as a function of the friction coefficient $\mu$ is shown. The upper line 76 indicates the efficiency $\eta$ of the drive in the forward direction when the worm 68 is driving the worm gear 60. In this forward drive condition, efficiency is reduced from 1.0 (or 100%) when there is no friction to slightly below 0.4 when the friction coefficient increases to about 0.15. Line 78 shows, however, that when the worm gear attempts to drive the worm, due to back drive forces from the camshaft, the drive efficiency $\eta$ is reduced from 1.0 at zero friction coefficient to zero at 0.08 friction coefficient and below zero at friction coefficients above 0.08.

This means that when the drive has a friction coefficient of 0.08, with the particular illustrated combination of 4.75° worm lead angle and 14.5° pressure angle of the teeth, then back drive forces from the camshaft will not be able to cause the worm gear to drive the worm. Instead, the system will tend to lock up so that back drive forces from the camshaft are offset by the friction forces and have no effect upon the drive motor 74, and the camshaft phase is not changed by any back drive forces initiated in the engine.

Thus it is clear that with the proper selection of worm lead angle and gear pressure angle, knowing the approximate friction coefficient of the worm to worm gear interface which is being utilized, it is possible to select a proper worm lead angle combination which will avoid any effect from back drive forces while at the same time providing significant torque multiplication for the drive motor. Accordingly, a relatively small electric drive motor may be utilized to drive the phase change mechanism using a worm gear system according to the invention while back drive forces are prevented from having any effect upon the motor or the cam phase setting.

However, if the friction coefficient increases over 0.08 or the worm lead angle is reduced, back drive forces will increase the frictional resistance to motion of the worm actuator and may require a larger motor to drive the worm. Nevertheless, the reduced friction coefficient during operation of the worm will assure fast response of the phase adjusting worm when it is moved from the stalled condition.

The following information is provided to aid in calculating and/or plotting efficiencies for a particular system. The forward and back driving efficiencies are functions of the gear pressure angles, worm lead angle, and the friction coefficient for the combination of the worm and worm gear materials, surface finishes, and lubricant.

The forward drive efficiency is:

$$\eta=(\cos\phi-\mu\tan\lambda)/(\cos\phi+\mu\cot\lambda)$$

The back drive efficiency is:

$$\eta=(\cos\phi-\mu\cot\lambda)/(\cos\phi+\mu\tan\lambda)$$

where:
$\eta$=efficiency
$\phi$=gear normal pressure angle
$\lambda$=worm lead angle
$\mu$=friction coefficient Another way of considering this concept is to look at the condition required for the back drive efficiency to equal (or be less than) zero. This occurs when:

$$\eta=0=(\cos\phi-\mu\cot\eta)/(\cos\phi+\mu\tan\eta)$$

$$\mu=\cos\phi\times\tan\eta$$

where:
$\eta$=efficiency
$\phi$=gear normal pressure angle
$\lambda$=worm lead angle
$\mu$=friction coefficient While the ranges of values for practical systems have not been fully determined, it is presently believed practical to use values in the following ranges:

$\phi$=gear normal pressure angle=14.5 to 30 degrees
$\gamma$=worm lead angle=3 to 10 degrees
$\mu$=friction coefficient=0.05 to 0.15

However, an actual production system may be based upon values outside this listed "practical" range.

In a test of an actual cam phaser system with the previously mentioned gear characteristics, an electric motor used to drive the worm had the following specifications:

| | | |
|---|---|---|
| motor supply voltage | 13.8 | V |
| motor inductance | 6.12 e-4 | H |
| motor torque constant | 0.01952 | Nm/amp |
| motor voltage constant | 0.01952 | V/rad |
| motor resistance (@ 25° C.) | 0.78 | Ohms |
| motor diameter | 40 | mm |
| motor length | 70 | mm |

Figure 3:
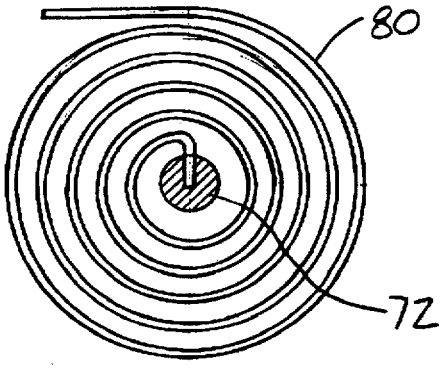
FIG. 3 is a fragmentary cross-sectional view from the plane of line 3—3 of FIG. 2 showing the application of a torsion return spring to the worm shaft 72.

In some cases, it may be desired to provide a cam phaser drive that returns, or allows return of, the cam phase to an initial, or base, setting when the motor is de-energized or the power falls. With the preferred system, which provides self locking of the gears against back driving, this may be accomplished by providing a return torsion spring 80 on the motor 74 or shaft 72 as shown, for example, in FIG. 3. When the motor 74 is moved in the timing advance (or retard) direction, the spring 80 is wound up to provide a return force. Then, when the motor is shut off, or power is lost, the spring force returns the shaft 72 to the initial position.

Alternatively, if the back driving cam forces tend to move the cam phaser toward the desired initial condition, it could be possible to delete the spring and select the worm lead angle so that the back drive forces will slowly return the phaser to the initial position when the motor is shut off.

Such automatic return systems, of course, require continuous energizing of the motor 74 to maintain the cam phaser in the advanced (or retarded) condition, whereas the preferred system first described requires energizing the motor only during a forward or reverse phase change. When the motor is de-energized, the self locking lead angle of the worm will prevent back driving from changing the set phase until the motor is again operated to make a change.

It should be apparent that the worm electric actuator described so far for use with a particular embodiment of planetary gear cam phaser could be equally well applied to other planetary arrangements. Such embodiments are possible wherein any of the planet carrier or the sun and ring gears is used to vary the phasing and the other two elements are used as input and output elements in either direction of drive.

Figure 6:
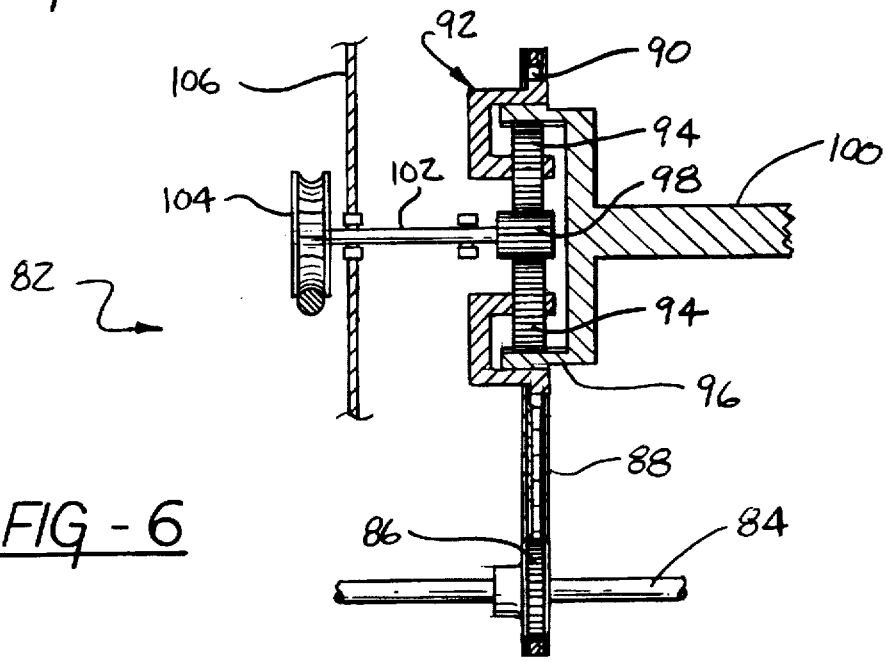
FIG. 6 is a schematic view showing an exemplary alternative form of planetary gear train arrangement in a cam phaser according to the invention.

One such planetary embodiment which could be adapted for use as a camshaft drive is shown schematically in FIG. 6 as installed in an engine 82. A crankshaft 84 has a driving sprocket 86 connected through timing chain 88 with a driven sprocket 90 forming part of a planet carrier 92. Carrier 92 supports planet gears 94 which engage a ring gear 96 and a sun gear 98 coaxial with the planet carrier. The ring gear 96 is connected with the engine camshaft 100 for driving the camshaft in proper phase with the crankshaft. The sun gear is connected by shaft 102 with a worm gear actuator 104 mounted on an outer cover 106 for rotatably varying the position of the sun gear 98 to vary the phase relation of the camshaft 100 relative to the crankshaft 84.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

I claim:

1. A planetary cam phaser for controlling the timing of a camshaft driven on a camshaft axis from a crankshaft of an associated engine, said phaser including a planetary gear train having a ring gear, a planet carrier and a sun gear rotatable on a common axis, the planet carrier supporting at least one rotatable planet gear engaging the ring and sun gears, one of said ring gear and said planet carrier comprising a driven member connectable with the crankshaft and the other of said ring gear and said planet carrier comprising a drive member connectable with the camshaft, the angular position of the sun gear being adjustable to vary the phasing of the camshaft relative to the crankshaft, said phaser characterized by:

a worm electric actuator for selectively adjusting said angular position of said sun gear, said actuator including a worm gear element coaxial with and drivingly connected to the sun gear, a worm driveably engaging the worm gear, and rotatable on a worm axis fixed with respect to the associated engine, and a controllable electric motor driveably connected to the worm.

2. The invention as in claim 1 characterized in that the worm lead angle is sufficiently low to provide self locking of the phaser against back driving cam torques.

3. The invention as in claim 2 characterized in that the worm lead angle is between 3 and 10 degrees.

4. The invention as in claim 2 characterized in that the worm lead angle is not greater than 6 degrees.

5. The invention as in claim 1 characterized in that the worm gear ratio is on the order of 20:1.

6. The invention as in claim 1 in combination with said associated engine wherein said engine includes a front cover enclosing said phaser, characterized in that the worm actuator is mounted on said cover.

7. The invention as in claim 1 characterized in that said motor is controllably reversible.

8. The invention as in claim 1 characterized in that said motor is connected with resilient return means which are energized upon operation of the motor in an initial direction and provide energy to return the actuator to an initial position when the motor is de-energized.

9. The invention as in claim 1 characterized in that said worm lead angle is great enough to allow back driving forces to return the actuator to an initial position when the motor is de-energized.

10. The invention as in claim 1 characterized in that said ring gear is the driven member and said planet carrier is the drive member.

11. The invention as in claim 1 characterized in that said planet carrier is the driven member and said ring gear is the drive member.

* * * * *